US007073598B2

(12) United States Patent
Haugen

(10) Patent No.: US 7,073,598 B2
(45) **Date of Patent: *Jul. 11, 2006**

(54) APPARATUS AND METHODS FOR TUBULAR MAKEUP INTERLOCK

(75) Inventor: David M. Haugen, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 199 days.

This patent is subject to a terminal disclaimer.

(21) Appl. No.: 10/625,840

(22) Filed: Jul. 23, 2003

(65) Prior Publication Data

US 2004/0069500 A1 Apr. 15, 2004

Related U.S. Application Data

(63) Continuation of application No. 09/860,127, filed on May 17, 2001, now Pat. No. 6,742,596.

(51) Int. Cl.
*E21B 19/16* (2006.01)

(52) U.S. Cl. ..... 166/380; 166/77.51; 166/85.1

(58) Field of Classification Search .. 166/77.51–77.53, 166/85.1, 377, 378, 380; 175/85
See application file for complete search history.

(56) References Cited

U.S. PATENT DOCUMENTS

| | | | |
|---|---|---|---|
| 122,514 | A | 1/1872 | Bullock |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell ..... 294/86.15 |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderliter |
| 2,167,338 | A | 7/1939 | Murcell |
| 2,214,429 | A | 9/1940 | Miller |
| 2,216,895 | A | 10/1940 | Stokes |

(Continued)

FOREIGN PATENT DOCUMENTS

| | | |
|---|---|---|
| CA | 2 355 192 | 11/2001 |

(Continued)

OTHER PUBLICATIONS

Detlef Hahn, Friedhelm Makohl, and Larry Watkins, Casing-While Drilling Stsem Reduces Hole Collapse Risks, Offshore, pp. 54, 56, and 59, Feb. 1998.

(Continued)

*Primary Examiner*—Zakiya W. Bates
(74) *Attorney, Agent, or Firm*—Patterson & Sheridan, LLP

(57) ABSTRACT

The present invention provides for an apparatus and methods to prevent an operator from inadvertently dropping a string into a wellbore during assembling and disassembling of tubulars. Additionally, the apparatus and methods can be used to for running in casing, running in wellbore components or for a drill string.

38 Claims, 10 Drawing Sheets

U.S. PATENT DOCUMENTS

| | | | | |
|---|---|---|---|---|
| 2,228,503 | A | 1/1941 | Boyd et al. | |
| 2,295,803 | A | 9/1942 | O'Leary | |
| 2,305,062 | A | 12/1942 | Church et al. | |
| 2,324,679 | A | 7/1943 | Cox | |
| 2,370,832 | A | 3/1945 | Baker | |
| 2,379,800 | A | 7/1945 | Hare | |
| 2,414,719 | A | 1/1947 | Cloud | |
| 2,499,630 | A | 3/1950 | Clark | |
| 2,522,444 | A | 9/1950 | Grable | |
| 2,536,458 | A | 1/1951 | Munsinger | |
| 2,610,690 | A | 9/1952 | Beatty | |
| 2,621,742 | A | 12/1952 | Brown | |
| 2,627,891 | A | 2/1953 | Clark | |
| 2,641,444 | A | 6/1953 | Moon | |
| 2,650,314 | A | 8/1953 | Hennigh et al. | |
| 2,663,073 | A | 12/1953 | Bieber et al. | |
| 2,668,689 | A | 2/1954 | Cormany | |
| 2,692,059 | A | 10/1954 | Bolling, Jr. | |
| 2,720,267 | A | 10/1955 | Brown | |
| 2,741,907 | A | 4/1956 | Genender et al. | |
| 2,743,087 | A | 4/1956 | Layne et al. | |
| 2,743,495 | A | 5/1956 | Eklund | |
| 2,738,011 | A | 6/1956 | Mabry | |
| 2,764,329 | A | 9/1956 | Hampton | |
| 2,765,146 | A | 10/1956 | Williams | |
| 2,805,043 | A | 9/1957 | Williams | |
| 2,953,406 | A | 9/1960 | Young | |
| 2,978,047 | A | 4/1961 | DeVaan | |
| 3,006,415 | A | 10/1961 | Burns et al. | |
| 3,041,901 | A | 7/1962 | Knights | |
| 3,054,100 | A | 9/1962 | Jones | |
| 3,087,546 | A | 4/1963 | Wooley | |
| 3,090,031 | A | 5/1963 | Lord | |
| 3,102,599 | A | 9/1963 | Hillburn | |
| 3,111,179 | A | 11/1963 | Albers et al. | |
| 3,117,636 | A | 1/1964 | Wilcox et al. | |
| 3,122,811 | A | 3/1964 | Gilreath | |
| 3,123,160 | A | 3/1964 | Kammerer | |
| 3,124,023 | A | 3/1964 | Marquis et al. | |
| 3,131,769 | A | 5/1964 | Rochemont | |
| 3,159,219 | A | 12/1964 | Scott | |
| 3,169,592 | A | 2/1965 | Kammerer | |
| 3,191,677 | A | 6/1965 | Kinley | |
| 3,191,680 | A | 6/1965 | Vincent | |
| 3,193,116 | A | 7/1965 | Kennedy et al. | 214/2.5 |
| 3,353,599 | A | 11/1967 | Swift | |
| 3,380,528 | A | 4/1968 | Timmons | 166/14 |
| 3,387,893 | A | 6/1968 | Hoever | |
| 3,392,609 | A | 7/1968 | Bartos | |
| 3,419,079 | A | 12/1968 | Current | |
| 3,477,527 | A | 11/1969 | Koot | |
| 3,489,220 | A | 1/1970 | Kinley | |
| 3,518,903 | A | 7/1970 | Ham et al. | |
| 3,548,936 | A | 12/1970 | Kilgore et al. | |
| 3,550,684 | A | 12/1970 | Cubberly, Jr. | |
| 3,552,507 | A | 1/1971 | Brown | |
| 3,552,508 | A | 1/1971 | Brown | |
| 3,552,509 | A | 1/1971 | Brown | |
| 3,552,510 | A | 1/1971 | Brown | |
| 3,552,848 | A | 1/1971 | Van Wagner | |
| 3,559,739 | A | 2/1971 | Hutchison | |
| 3,566,505 | A | 3/1971 | Martin | 29/200 |
| 3,570,598 | A | 3/1971 | Johnson | 166/178 |
| 3,575,245 | A | 4/1971 | Cordary et al. | |
| 3,602,302 | A | 8/1971 | Kluth | |
| 3,603,411 | A | 9/1971 | Link | |
| 3,603,412 | A | 9/1971 | Kammerer, Jr. et al. | |
| 3,603,413 | A | 9/1971 | Grill et al. | |
| 3,606,664 | A | 9/1971 | Weiner | |
| 3,624,760 | A | 11/1971 | Bodine | |
| 3,635,105 | A | 1/1972 | Dickmann et al. | 81/57.18 |
| 3,656,564 | A | 4/1972 | Brown | |
| 3,662,842 | A | 5/1972 | Bromell | |
| 3,669,190 | A | 6/1972 | Sizer et al. | |
| 3,680,412 | A | 8/1972 | Mayer et al. | |
| 3,691,624 | A | 9/1972 | Kinley | |
| 3,691,825 | A | 9/1972 | Dyer | 73/136 A |
| 3,692,126 | A | 9/1972 | Rushing et al. | |
| 3,696,332 | A | 10/1972 | Dickson, Jr. et al. | |
| 3,700,048 | A | 10/1972 | Desmoulins | |
| 3,729,057 | A | 4/1973 | Werner | |
| 3,746,330 | A | 7/1973 | Taciuk | |
| 3,747,675 | A | 7/1973 | Brown | 166/237 |
| 3,760,894 | A | 9/1973 | Pitifer | |
| 3,766,320 | A | 10/1973 | Homme | 179/5 R |
| 3,776,320 | A | 12/1973 | Brown | |
| 3,776,991 | A | 12/1973 | Marcus | 264/89 |
| 3,785,193 | A | 1/1974 | Kinley et al. | |
| 3,808,916 | A | 5/1974 | Porter et al. | |
| 3,838,613 | A | 10/1974 | Wilms | |
| 3,840,128 | A | 10/1974 | Swoboda, Jr. et al. | |
| 3,848,684 | A | 11/1974 | West | 175/195 |
| 3,857,450 | A | 12/1974 | Guier | 175/85 |
| 3,870,114 | A | 3/1975 | Pulk et al. | |
| 3,881,375 | A | 5/1975 | Kelly | |
| 3,885,679 | A | 5/1975 | Swoboda, Jr. et al. | |
| 3,901,331 | A | 8/1975 | Djurovic | |
| 3,913,687 | A | 10/1975 | Gyongyosi et al. | 175/85 |
| 3,915,244 | A | 10/1975 | Brown | |
| 3,934,660 | A | 1/1976 | Nelson | |
| 3,945,444 | A | 3/1976 | Knudson | |
| 3,947,009 | A | 3/1976 | Nelmark | |
| 3,964,556 | A | 6/1976 | Gearhart et al. | |
| 3,980,143 | A | 9/1976 | Swartz et al. | |
| 4,049,066 | A | 9/1977 | Richey | |
| 4,054,332 | A | 10/1977 | Bryan, Jr. | |
| 4,054,426 | A | 10/1977 | White | |
| 4,064,939 | A | 12/1977 | Marquis | |
| 4,077,525 | A | 3/1978 | Callegari et al. | |
| 4,082,144 | A | 4/1978 | Marquis | |
| 4,083,405 | A | 4/1978 | Shirley | |
| 4,085,808 | A | 4/1978 | Kling | |
| 4,095,865 | A | 6/1978 | Denison et al. | |
| 4,100,968 | A | 7/1978 | Delano | 166/315 |
| 4,100,981 | A | 7/1978 | Chaffin | |
| 4,127,927 | A | 12/1978 | Hauk et al. | |
| 4,133,396 | A | 1/1979 | Tschirky | |
| 4,142,739 | A | 3/1979 | Billingsley | |
| 4,173,457 | A | 11/1979 | Smith | |
| 4,175,619 | A | 11/1979 | Davis | |
| 4,186,628 | A | 2/1980 | Bonnice | |
| 4,189,185 | A | 2/1980 | Kammerer, Jr. et al. | |
| 4,194,383 | A | 3/1980 | Huzyak | |
| 4,221,269 | A | 9/1980 | Hudson | |
| 4,227,197 | A | 10/1980 | Nimmo et al. | |
| 4,241,878 | A | 12/1980 | Underwood | |
| 4,257,442 | A | 3/1981 | Claycomb | |
| 4,262,693 | A | 4/1981 | Giebeler | |
| 4,274,777 | A | 6/1981 | Scaggs | |
| 4,274,778 | A | 6/1981 | Putnam et al. | |
| 4,277,197 | A | 7/1981 | Bingham | |
| 4,280,380 | A | 7/1981 | Eshghy | |
| 4,281,722 | A | 8/1981 | Tucker et al. | |
| 4,287,949 | A | 9/1981 | Lindsey, Jr. | |
| 4,311,195 | A | 1/1982 | Mullins, II | |
| 4,315,553 | A | 2/1982 | Stallings | |
| 4,320,915 | A | 3/1982 | Abbott et al. | 294/96 |
| 4,336,415 | A | 6/1982 | Walling | |
| 4,384,627 | A | 5/1983 | Ramirez-Jauregui | |
| 4,392,534 | A | 7/1983 | Miida | |
| 4,396,076 | A | 8/1983 | Inoue | |
| 4,396,077 | A | 8/1983 | Radtke | |
| 4,407,378 | A | 10/1983 | Thomas | |
| 4,408,669 | A | 10/1983 | Wiredal | |

4,413,682 A 11/1983 Callihan et al.
4,427,063 A 1/1984 Skinner
4,437,363 A 3/1984 Haynes ..... 81/57.18
4,440,220 A 4/1984 McArthur
4,445,734 A 5/1984 Cunningham
4,446,745 A 5/1984 Stone et al.
4,449,596 A 5/1984 Boyadjieff ..... 175/85
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates ..... 81/57.18
4,515,045 A 5/1985 Gnatchenko et al.
4,529,045 A 7/1985 Boyadjieff et al. ..... 173/164
4,544,041 A 10/1985 Rinaldi
4,545,443 A 10/1985 Wiredal
4,570,706 A 2/1986 Pugnet ..... 166/77.5
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie ..... 175/85
4,595,058 A 6/1986 Nations
4,604,724 A 8/1986 Shaginian et al. ..... 700/213
4,604,818 A 8/1986 Inoue
4,605,077 A 8/1986 Boyadjieff ..... 175/85
4,605,268 A 8/1986 Meador
4,620,600 A 11/1986 Persson
4,625,796 A 12/1986 Boyadjieff ..... 166/77.5
4,630,691 A 12/1986 Hooper
4,646,827 A 3/1987 Cobb
4,649,777 A 3/1987 Buck ..... 81/57.19
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al. ..... 81/57.34
4,760,882 A 8/1988 Novak
4,762,187 A 8/1988 Haney ..... 175/171
4,765,401 A 8/1988 Boyadjieff ..... 166/77.53
4,765,416 A 8/1988 Bjerking et al.
4,773,689 A 9/1988 Wolters ..... 294/88
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov ..... 175/57
4,793,422 A 12/1988 Krasnov
4,800,968 A 1/1989 Shaw et al. ..... 175/85
4,806,928 A 2/1989 Veneruso
4,813,493 A 3/1989 Shaw et al. ..... 173/164
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator ..... 81/57.18
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al. ..... 166/77.5
4,878,546 A 11/1989 Shaw et al. ..... 173/163
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al. ..... 166/379
5,009,265 A 4/1991 Bailey et al. ..... 166/118
5,022,472 A 6/1991 Bailey et al.
5,027,914 A 7/1991 Wilson
5,036,927 A 8/1991 Willis ..... 175/162
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger et al.
5,074,366 A 12/1991 Karlsson et al.
5,082,069 A 1/1992 Seiler et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley ..... 166/379
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson ..... 175/220
5,255,741 A 10/1993 Alexander
5,255,751 A 10/1993 Stogner ..... 175/203
5,271,468 A 12/1993 Streich et al.
5,271,472 A 12/1993 Leturno
5,272,925 A 12/1993 Henneuse et al.
5,282,653 A 2/1994 LaFleur et al. ..... 285/110
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al. ..... 294/102.2

5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al. ..... 175/162
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry ..... 175/85
5,392,715 A 2/1995 Pelrine
5,394,823 A 3/1995 Lenze
5,402,856 A 4/1995 Warren et al.
5,433,279 A 7/1995 Tessari et al. ..... 173/213
5,435,400 A 7/1995 Smith
5,452,923 A 9/1995 Smith
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry ..... 175/52
5,503,234 A 4/1996 Clanton ..... 175/52
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,546,317 A 8/1996 Andrieu
5,547,029 A 8/1996 Rubbo et al.
5,551,521 A 9/1996 Vail, III
5,553,672 A 9/1996 Smith, Jr. et al. ..... 166/382
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al. ..... 175/321
5,582,259 A 12/1996 Barr
5,584,343 A 12/1996 Coone ..... 166/387
5,588,916 A 12/1996 Moore
5,613,567 A 3/1997 Hudson
5,615,747 A 4/1997 Vail, III
5,645,131 A 7/1997 Trevisani ..... 175/171
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III ..... 166/285
5,735,351 A 4/1998 Helms
5,743,344 A 4/1998 McLeod et al.
5,746,276 A 5/1998 Stuart
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al. ..... 166/77.1
5,794,703 A 8/1998 Newman et al.
5,803,191 A 9/1998 Mackintosh ..... 175/170
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde ..... 166/321
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al. ..... 166/77.1
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins ..... 166/387
5,971,086 A 10/1999 Bee et al.
5,984,007 A 11/1999 Yuan et al.
5,988,273 A 11/1999 Monjure et al.
6,000,472 A 12/1999 Albright et al. ..... 166/380
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al. ..... 166/380
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al. ..... 81/57.33
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod 6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al. ..... 173/55
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al. ..... 175/162
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B1 3/2002 Quigley et al.
6,359,569 B1 3/2002 Beck et al.
6,360,633 B1 3/2002 Pietras
6,367,552 B1 4/2002 Scott et al.
6,367,566 B1 4/2002 Hill
6,371,203 B1 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B1 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al. ..... 166/80.1
6,412,574 B1 7/2002 Wardley et al.
6,419,014 B1 7/2002 Meek et al.
6,419,033 B1 7/2002 Hahn et al.
6,423,241 B1 7/2002 Yoon et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,723 B1 9/2002 Ramos et al.
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B1 3/2003 Birckhead et al.
6,536,993 B1 3/2003 Strong et al.
6,538,576 B1 3/2003 Schultz et al.
6,540,025 B1 4/2003 Scott et al.
6,543,552 B1 4/2003 Metcalfe et al.
6,547,017 B1 4/2003 Vail, III
6,553,825 B1 4/2003 Boyd
6,554,064 B1 4/2003 Restarick et al.
6,585,040 B1 7/2003 Hanton et al.
6,591,471 B1 7/2003 Hollingsworth et al.
6,595,288 B1 7/2003 Mosing et al.
6,619,402 B1 9/2003 Amory et al.
6,622,796 B1 9/2003 Pietras
6,634,430 B1 10/2003 Dawson et al.
6,637,526 B1 10/2003 Juhasz et al.
6,648,075 B1 11/2003 Badrak et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,679,333 B1 1/2004 York et al.
6,688,394 B1 2/2004 Ayling
6,688,398 B1 2/2004 Pietras
6,691,801 B1 2/2004 Juhasz et al.
6,698,595 B1 3/2004 Norell et al.
6,702,040 B1 3/2004 Sensenig
6,708,769 B1 3/2004 Haugen et al.
6,715,430 B1 4/2004 Choi et al.
6,719,071 B1 4/2004 Moyes
6,725,924 B1 4/2004 Davidson et al.
6,725,938 B1 4/2004 Pietras
6,732,822 B1 5/2004 Slack et al.
6,742,584 B1 6/2004 Appleton
6,742,596 B1 6/2004 Haugen
6,742,606 B1 6/2004 Metcalfe et al.
6,745,834 B1 6/2004 Davis et al.
6,752,211 B1 6/2004 Dewey et al.
6,776,233 B1 8/2004 Meehan
6,832,656 B1 12/2004 Fournier, Jr. et al.
6,832,658 B1 12/2004 Keast
6,837,313 B1 1/2005 Hosie et al.
6,840,322 B1 1/2005 Haynes
6,848,517 B1 2/2005 Wardley
6,854,533 B1 2/2005 Galloway
6,857,486 B1 2/2005 Chitwood et al.
6,857,487 B1 2/2005 Brunnert et al.
6,868,906 B1 3/2005 Vail, III et al.
6,877,553 B1 4/2005 Cameron
6,892,835 B1 5/2005 Shahin et al.
6,896,075 B1 5/2005 Haugen et al.
6,899,186 B1 5/2005 Galloway et al.
6,899,772 B1 5/2005 Morando
2001/0042625 A1 11/2001 Appleton ..... 166/379
2002/0040787 A1 4/2002 Cook et al.
2002/0066556 A1 6/2002 Goode et al.
2002/0108748 A1 8/2002 Keyes
2002/0134555 A1 9/2002 Allen et al. ..... 166/377
2002/0170720 A1 11/2002 Haugen
2002/0189863 A1 12/2002 Wardley
2003/0029641 A1 2/2003 Meehan
2003/0056947 A1 3/2003 Cameron
2003/0056991 A1 3/2003 Hahn et al.
2003/0070841 A1 4/2003 Merecka et al.
2003/0070842 A1 4/2003 Bailey et al.
2003/0111267 A1 6/2003 Pia
2003/0141111 A1 7/2003 Pia
2003/0146023 A1 8/2003 Pia
2003/0164250 A1 9/2003 Wardley
2003/0164251 A1 9/2003 Tulloch
2003/0164276 A1 9/2003 Snider et al.
2003/0173073 A1 9/2003 Snider et al.
2003/0173090 A1 9/2003 Cook et al.
2003/0213598 A1 11/2003 Hughes
2003/0217885 A1 11/2003 Simpson et al.

| | | | |
|---|---|---|---|
| 2003/0221519 | A1 | 12/2003 | Haugen et al. |
| 2004/0000405 | A1 | 1/2004 | Fournier, Jr. et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0060697 | A1 | 4/2004 | Tilton et al. |
| 2004/0069500 | A1 | 4/2004 | Haugen |
| 2004/0079533 | A1 | 4/2004 | Buytaert et al. |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Valle et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0096846 | A1 | 5/2005 | Koithan et al. |

FOREIGN PATENT DOCUMENTS

| | | | |
|---|---|---|---|
| DE | 3 213 464 | | 10/1983 |
| DE | 3 523 221 | | 2/1987 |
| DE | 3 918 132 | | 12/1989 |
| DE | 4 133 802 | | 10/1992 |
| EP | 0 087 373 | | 8/1983 |
| EP | 0 162 000 | | 11/1985 |
| EP | 01 62000 | A1 | 11/1985 |
| EP | 0 171 144 | | 2/1986 |
| EP | 0 235 105 | | 9/1987 |
| EP | 0 265 344 | | 4/1988 |
| EP | 0 285 386 | | 10/1988 |
| EP | 0 426 123 | | 5/1991 |
| EP | 0 462 618 | | 12/1991 |
| EP | 0 474 481 | | 3/1992 |
| EP | 0479583 | | 4/1992 |
| EP | 0 525 247 | | 2/1993 |
| EP | 0 525 247 | A1 | 2/1993 |
| EP | 0 554 568 | | 8/1993 |
| EP | 0 589 823 | | 3/1994 |
| EP | 0 659 975 | | 6/1995 |
| EP | 0 790 386 | | 8/1997 |
| EP | 0 881 354 | | 4/1998 |
| EP | 0 571 045 | | 8/1998 |
| EP | 0 961 007 | | 12/1999 |
| EP | 0 962 384 | | 12/1999 |
| EP | 1 006 260 | | 6/2000 |
| EP | 1 050 661 | | 11/2000 |
| EP | 1148206 | | 10/2001 |
| EP | 1 256 691 | | 11/2002 |
| FR | 2053088 | | 7/1970 |
| FR | 2741907 | | 6/1997 |
| FR | 2 841 293 | | 12/2003 |
| GB | 540 027 | | 10/1941 |
| GB | 709 365 | | 5/1954 |
| GB | 716 761 | | 10/1954 |
| GB | 7 928 86 | | 4/1958 |
| GB | 8 388 33 | | 6/1960 |
| GB | 881 358 | | 11/1961 |
| GB | 9 977 21 | | 7/1965 |
| GB | 1 277 461 | | 6/1972 |
| GB | 1 306 568 | | 3/1973 |
| GB | 1 448 304 | | 9/1976 |
| GB | 1 469 661 | | 4/1977 |
| GB | 1 582 392 | | 1/1981 |
| GB | 2 053 088 | | 2/1981 |
| GB | 2 115 940 | | 9/1983 |
| GB | 0 171 144 | A1 | 2/1986 |
| GB | 2 170 528 | | 8/1986 |
| GB | 2 201 912 | | 9/1988 |
| GB | 2 216 926 | | 10/1989 |
| GB | 2 223 253 | | 4/1990 |
| GB | 2 224 481 | | 9/1990 |
| GB | 2 240 799 | | 8/1991 |
| GB | 2 275 486 | | 4/1993 |
| GB | 2 294 715 | | 8/1996 |
| GB | 2 313 860 | | 2/1997 |
| GB | 2 320 270 | | 6/1998 |
| GB | 2 324 108 | | 10/1998 |
| GB | 2 333 542 | | 7/1999 |
| GB | 2 335 217 | | 9/1999 |
| GB | 2 345 074 | | 6/2000 |
| GB | 2 347 445 | | 9/2000 |
| GB | 2 348 223 | | 9/2000 |
| GB | 2 349 401 | | 11/2000 |
| GB | 2 350 137 | | 11/2000 |
| GB | 2 357 101 | | 6/2001 |
| GB | 2 357 530 | | 6/2001 |
| GB | 2 352 747 | | 7/2001 |
| GB | 2 365 463 | | 2/2002 |
| GB | 2 372 271 | | 8/2002 |
| GB | 2 372 765 | | 9/2002 |
| GB | 2 381 809 | | 5/2003 |
| GB | 2 382 361 | | 5/2003 |
| GB | 2 386 626 | | 9/2003 |
| GB | 2 389 130 | | 12/2003 |
| RU | 2 079 633 | | 5/1997 |
| WO | WO 90-06418 | | 6/1990 |
| WO | WO 91-16520 | | 10/1991 |
| WO | WO 92-01139 | | 1/1992 |
| WO | WO 92-18743 | | 10/1992 |
| WO | WO 92-20899 | | 11/1992 |
| WO | WO 93/07358 | | 4/1993 |
| WO | WO 93-24728 | | 12/1993 |
| WO | WO 95-10686 | | 4/1995 |
| WO | WO 96/18799 | | 6/1996 |
| WO | WO 96-28635 | | 9/1996 |
| WO | WO 97-05360 | | 2/1997 |
| WO | WO 97-08418 | | 3/1997 |
| WO | WO 98/01651 | | 1/1998 |
| WO | WO 98/05844 | | 2/1998 |
| WO | WO 98-09053 | | 3/1998 |
| WO | WO 98/32948 | | 7/1998 |
| WO | WO 98/11322 | | 9/1998 |
| WO | WO 98-55730 | | 12/1998 |
| WO | WO 99-04135 | | 1/1999 |
| WO | WO 99-11902 | | 3/1999 |
| WO | WO 99-23354 | | 5/1999 |
| WO | WO 99-24689 | | 5/1999 |
| WO | WO 99/35368 | | 7/1999 |
| WO | WO 99-37881 | | 7/1999 |
| WO | WO 99/41485 | | 8/1999 |
| WO | WO 99/58810 | | 11/1999 |
| WO | WO 99-64713 | | 12/1999 |
| WO | WO 00/04269 | | 1/2000 |
| WO | WO 00/05483 | | 2/2000 |
| WO | WO 00-08293 | | 2/2000 |
| WO | WO 00/09853 | | 2/2000 |
| WO | WO 00/11309 | | 3/2000 |
| WO | WO 00/11310 | | 3/2000 |

| | | |
|---|---|---|
| WO | WO 00/11311 | 3/2000 |
| WO | WO 00-28188 | 5/2000 |
| WO | WO 00-37766 | 6/2000 |
| WO | WO 00-37771 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00-50730 | 8/2000 |
| WO | WO 00/52297 | 9/2000 |
| WO | WO 00/66879 | 11/2000 |
| WO | WO 01-12946 | 2/2001 |
| WO | WO 01-46550 | 6/2001 |
| WO | WO 01/59253 | 8/2001 |
| WO | WO 01-79650 | 10/2001 |
| WO | WO 01-81708 | 11/2001 |
| WO | WO 01-83932 | 11/2001 |
| WO | WO 01-94738 | 12/2001 |
| WO | WO 01-94739 | 12/2001 |
| WO | WO 02/14649 | 2/2002 |
| WO | WO 02/44601 | 6/2002 |
| WO | WO 02/081863 | 10/2002 |
| WO | WO 02-086287 | 10/2002 |
| WO | WO 03/006790 | 1/2003 |
| WO | WO 03-074836 | 9/2003 |
| WO | WO 03/087525 | 10/2003 |
| WO | WO 2004/022903 | 3/2004 |

OTHER PUBLICATIONS

Yakov A. Gelfgat, Mikhail Y. Gelfgat and Yuri S. Lopatin, Retractable Drill Bit Technology—Drilling Without Puling Out Drillpipe, Advanced Drilling Solutions Lessons From the FSU: Jun. 2003; vol. 2, pp. 351-464.
Tommy Warren, SPE, Bruce Houtchens, SPE, Garrett Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
Autoseal Circulating Head; LaFleur Petroleum Services; 1992.
Valves, Wellhead Equipment, Safety System; W-K-M Division, ACF Industries, 1980.
Top Drive Drilling Systems, Canrig, Feb. 1997 in Hart's Petroleum Engineer.
More Portable Top Drive Installations, Tesco Drilling Technology, 1997.
Portable Top Drives, Drilling Contractor, Cover & 3pp. Sep. 1994.
500 or 650 HCIS Top Drive, Tesco Drilling Technology, Apr. 1998.
500 or 650 ECIS Top Drive, Tesco Drilling Technology, Apr. 1998.
Product information, (Sections 1-10) Canrig, 1996.
Hahn, et al., "Simultaneous Drill and Case Technology—Case Histories, Status and Options for Further Development," Society of Petroleum Engineers, IADC/SPE Drilling Conference, new Orlean, LA Feb. 23-25, 2000 pp. 1-9.
M.B. Stone and J. Smith, "Expandable Tubulars and Casing Drilling are Otions" Drilling Contractor, Jan./Feb. 2002, pp. 52.
M. Gelfgat, "Retractable Bits Development and Application" Transactions of the ASME, vol. 120, Jun. (1998), pp. 124-130.
"First Success with Casing-Drilling" World Oil, Feb. (1999), vol. 220, No. 2.
Dean E. Gaddy, Editor, "Russia Shares Technical Know-How with U.S." Oil & Gas Journal, Mar. (1999), pp. 51-52 and 54-56.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exihbition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 21-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conference, Mar. 6-7,2003, pp. 1-7.
Vincent, et al., "Liner And Casing Drilling—Case histories And Technology," paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For use In drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse, Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
The Original Portable Top Drive Drilling System, TESCO Drilling Technology, 1997.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utitizing a New Inner String Liner Cementing Process, 1998.

Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges In Deep Waters And Maturing Properties, IBP 27500, Brazilian Petroleum Institute—IBP, 2000.
Coiled Tubing Handbook, World Oil, Gulf Publishing Company, 1993.

APPARATUS AND METHODS FOR TUBULAR MAKEUP INTERLOCK

CROSS-REFERENCE TO RELATED APPLICATIONS

This application is a continuation of U.S. patent application Ser. No. 09/860,127, filed May 17, 2001 now U.S. Pat. No. 6,742,596, which application is herein incorporated by reference in its entirety.

BACKGROUND OF THE INVENTION

1. Field of the Invention

The present invention relates to an apparatus and methods for facilitating the connection of tubulars. More particularly, the invention relates to an interlock system for a ton drive and a snider for use in assembling or disassembling tubulars.

2. Background of the Related Art

In the construction and completion of oil or gas wells, a drilling rig is constructed on the earth's surface to facilitate the insertion and removal of tubular strings into a wellbore. The drilling rig includes a platform and power tools such as an elevator and a spider to engage, assemble, and lower the tubulars into the wellbore. The elevator is suspended above the platform by a draw works that can raise or lower the elevator in relation to the floor of the rig. The spider is mounted in the platform floor. The elevator and spider both have slips that are capable of engaging and releasing a tubular, and are designed to work in tandem. Generally, the spider holds a tubular or tubular string that extends into the wellbore from the platform. The elevator engages a new tubular and aligns it over the tubular being held by the spider. A power tong and a spinner are then used to thread the upper and lower tubulars together. Once the tubulars are joined, the spider disengages the tubular string and the elevator lowers the tubular string through the spider until the elevator and spider are at a predetermined distance from each other. The spider then re-engages the tubular string and the elevator disengages the string and repeats the process. This sequence applies to assembling tubulars for the purpose of drilling a wellbore, running casing to line the wellbore, or running wellbore components into the well. The sequence can be reversed to disassemble the tubular string.

During the drilling of a wellbore, a drill string is made up and is then necessarily rotated in order to drill. Historically, a drilling platform includes a rotary table and a gear to turn the table. In operation, the drill string is lowered by an elevator into the rotary table and held in place by a spider. A Kelly is then threaded to the string and the rotary table is rotated, causing the Kelly and the drill string to rotate. After thirty feet or so of drilling, the Kelly and a section of the string are lifted out of the wellbore, and additional drill string is added.

The process of drilling with a Kelly is expensive due to the amount of time required to remove the Kelly, add drill string, reengage the Kelly, and rotate the drill string. In order to address these problems, top drives were developed.

For example, International Application Number PCT/GB99/02203, published on Feb. 3, 2000 discloses apparatus and methods for connecting tubulars using a top drive. In another example, FIG. 1 shows a drilling rig 100 configured to connect and run casings into a newly formed wellbore 180 to line the walls thereof. As shown, the rig 100 includes a top drive 200, an elevator 120, and a spider 400. The rig 100 is built at the surface 170 of the well. The rig 100 includes a traveling block 110 that is suspended by wires 150 from draw works 105 and holds the top drive 200. The top drive 200 has a gripping means 301 for engaging the inner wall of the casing 15 and a motor 240 to rotate the casing 15. The motor 240 may rotate and thread the casing 15 into the casing string 16 held by the spider 400. The gripping means 301 facilitate the engagement and disengagement of the casing 15 without having to thread and unthread the casing 15 to the top drive 200. Additionally, the top drive 200 is coupled to a railing system 140. The railing system 140 prevents the top drive 200 from rotational movement during rotation of the casing string 16, but allows for vertical movement of the top drive 200 under the traveling block 110.

In FIG. 1, the top drive 200 is shown engaged to casing 15. The casing 15 is placed in position below the top drive 200 by the elevator 120 in order for the top drive 200 to engage the casing 15. Additionally, the spider 400, disposed on the platform 160, is shown engaged around a casing string 16 that extends into wellbore 180. Once the casing 15 is positioned above the casing string 16, the top drive 200 can lower and thread the casing 15 into the casing string 16, thereby extending the length of the casing string 16. Thereafter, the extended casing string 16 may be lowered into the wellbore 180.

FIG. 2 illustrates the top drive 200 engaged to the casing string 16 after the casing string 16 has been lowered through a spider 400. The spider 400 is shown disposed on the platform 160. The spider 400 comprises a slip assembly 440 including a set of slips 410 and piston 420. The slips 410 are wedge-shaped and constructed and arranged to slidably move along a sloped inner wall of the slip assembly 440. The slips 410 are raised or lowered by the piston 420. When the slips 410 are in the lowered position, they close around the outer surface of the casing string 16. The weight of the casing string 16 and the resulting friction between the casing string 16 and the slips 410 force the slips downward and inward, thereby tightening the grip on the casing string 16. When the slips 410 are in the raised position as shown, the slips 410 are opened and the casing string 16 is free to move axially in relation to the slips 410.

FIG. 3 is cross-sectional view of a top drive 200 and a casing 15. The top drive 200 includes a gripping means 301 having a cylindrical body 300, a wedge lock assembly 350, and slips 340 with teeth (not shown). The wedge lock assembly 350 and the slips 340 are disposed around the outer surface of the cylindrical body 300. The slips 340 are constructed and arranged to mechanically grip the inside of the casing 15. The slips 340 are threaded to piston 370 located in a hydraulic cylinder 310. The piston 370 is actuated by pressurized hydraulic fluid injected through fluid ports 320, 330. Additionally, springs 360 are located in the hydraulic cylinder 310 and are shown in a compressed state. When the piston 370 is actuated, the springs 360 decompress and assist the piston 370 in moving the slips 340 relative to the cylindrical body 300. The wedge lock assembly 350 is connected to the cylindrical body 300 and constructed and arranged to force the slips 340 against the inner wall of the casing 15.

In operation, the slips 340, and the wedge lock assembly 350 of top drive 200 are lowered inside the casing 15. Once the slips 340 are in the desired position within the casing 15, pressurized fluid is injected into the piston 370 through fluid port 320. The fluid actuates the piston 370, which forces the slips 340 towards the wedge lock assembly 350. The wedge lock assembly 350 functions to bias the slips 340 outwardly as the slips 340 are slidably forced along the outer surface of the assembly 350, thereby forcing the slips 340 to engage the inner wall of the casing 15.

FIG. 4 illustrates a cross-sectional view of a top drive 200 engaged to the casing 15. Particularly, the figure shows the slips 340 engaged with the inner wall of the casing 15 and a spring 360 in the decompressed state. In the event of a hydraulic fluid failure, the springs 360 can bias the piston 370 to keep the slips 340 in the engaged position, thereby providing an additional safety feature to prevent inadvertent release of the casing string 16. Once the slips 340 are engaged with the casing 15, the top drive 200 can be raised along with the cylindrical body 300. By raising the body 300, the wedge lock assembly 350 will further bias the slips 340 outward. With the casing 15 retained by the top drive 200, the top drive 200 may relocate the casing 15 to align and thread the casing 15 with casing string 16.

In another embodiment (not shown), a top drive includes a gripping means for engaging a casing on the outer surface. For example, the slips of the gripping means can be arranged to grip on the outer surface of the casing, preferably gripping under the collar of the casing. In operation, the top drive is positioned over the desired casing. The slips are then lowered by the top drive to engage the collar of the casing. Once the slips are positioned beneath the collar, the piston is actuated to cause the slips to grip the outer surface of the casing.

FIG. 5 is a flow chart illustrating a typical operation of running casing using a top drive 200 and a spider 400. The flow chart relates to the operation of an apparatus generally illustrated in FIG. 1. At a first step 500, a casing string 16 is retained in a closed spider 400 and is thereby prevented from moving in an axial direction. At step 510, top drive 200 is moved to engage a casing 15 with the aid of an elevator 120. Engagement of the casing 15 by the top drive 200 includes grasping the casing 15 and engaging the inner surface thereof. At step 520, the top drive 200 moves the casing 15 into position above the casing string 16 for connection therewith. At step 530, the top drive 200 threads the casing 15 to casing string 16. At step 540, the spider 400 is opened and disengages the casing string 16. At step 550, the top drive 200 lowers the extended casing string 16 through the opened spider 400. At step 560, the spider 400 is closed around the casing string 16. At step 570, the top drive 200 disengages the casing string 16 and can proceed to add another casing 15 to the casing string 16 as in step 510. The above-described steps may be utilized to run drill string in a drilling operation, to run casing to reinforce the wellbore, or to assemble run-in strings to place wellbore components in the wellbore. The steps may also be reversed in order to disassemble a tubular string.

Although the top drive is a good alternative to the Kelly and rotary table, the possibility of inadvertently dropping a casing string into the wellbore exists. As noted above, a top drive and spider must work in tandem, that is, at least one of them must engage the casing string at any given time during casing assembly. Typically, an operator located on the platform controls the top drive and the spider with manually operated levers that control fluid power to the slips that cause the top drive and spider to retain a casing string. At any given time, an operator can inadvertently drop the casing string by moving the wrong lever. Conventional interlocking systems have been developed and used with elevator/spider systems to address this problem, but there remains a need for a workable interlock system usable with a top drive/spider system such as the one described herein.

There is a need therefore, for an interlock system for use with a top drive and spider to prevent inadvertent release of a tubular string. There is a further need for an interlock system to prevent the inadvertent dropping of a tubular or tubular string into a wellbore. There is also a need for an interlock system that prevents a spider or a top drive from disengaging a tubular string until the other component has engaged the tubular.

SUMMARY OF THE INVENTION

The present invention generally provides an apparatus and methods to prevent inadvertent release of a tubular or tubular string. In one aspect, the apparatus and methods disclosed herein ensure that either the top drive or the spider is engaged to the tubular before the other component is disengaged from the tubular. The interlock system is utilized with a spider and a top drive during assembly of a tubular string.

In another aspect, the present invention provides an apparatus for use with tubulars. The apparatus includes a first device for gripping and joining the tubulars, a second device for gripping the tubulars, and an interlock system to ensure that the tubulars are gripped by at least one of the first or second device.

In another aspect still, the present invention provides a method for assembling and dissembling tubulars. The method includes joining a first tubular engaged by a first apparatus to a second tubular engaged by a second apparatus thereby forming a tubular string. An interlock system is provided to ensure that at least one of the first apparatus or the second apparatus is engaging the tubular string. After the tubulars are joined, the second apparatus is opened to disengage the string, thereby allowing the tubular string to be lowered through the second apparatus. After the string is repositioned, the second apparatus is actuated to re-engage the tubular string. After the second apparatus secures the tubular string, the first apparatus is disengaged from the string.

In another aspect still, the first apparatus includes a gripping member for engaging the tubular. In one aspect, the gripping member is movably coupled to the first apparatus. Particularly, the gripping member may pivot relative to the first apparatus to facilitate engagement with the tubular. In one embodiment, a swivel is used to couple the gripping member to the first apparatus.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore, not to be considered limiting of its scope, for the invention may admit to other equally effective embodiments.

DETAILED DESCRIPTION OF THE PREFERRED EMBODIMENT

The present invention is an interlock system for use with a top drive and a spider during assembly of a string of tubulars. The invention may be utilized to assemble tubulars for different purposes including drill strings, strings of liner and casing and run-in strings for wellbore components.

Figure 1:
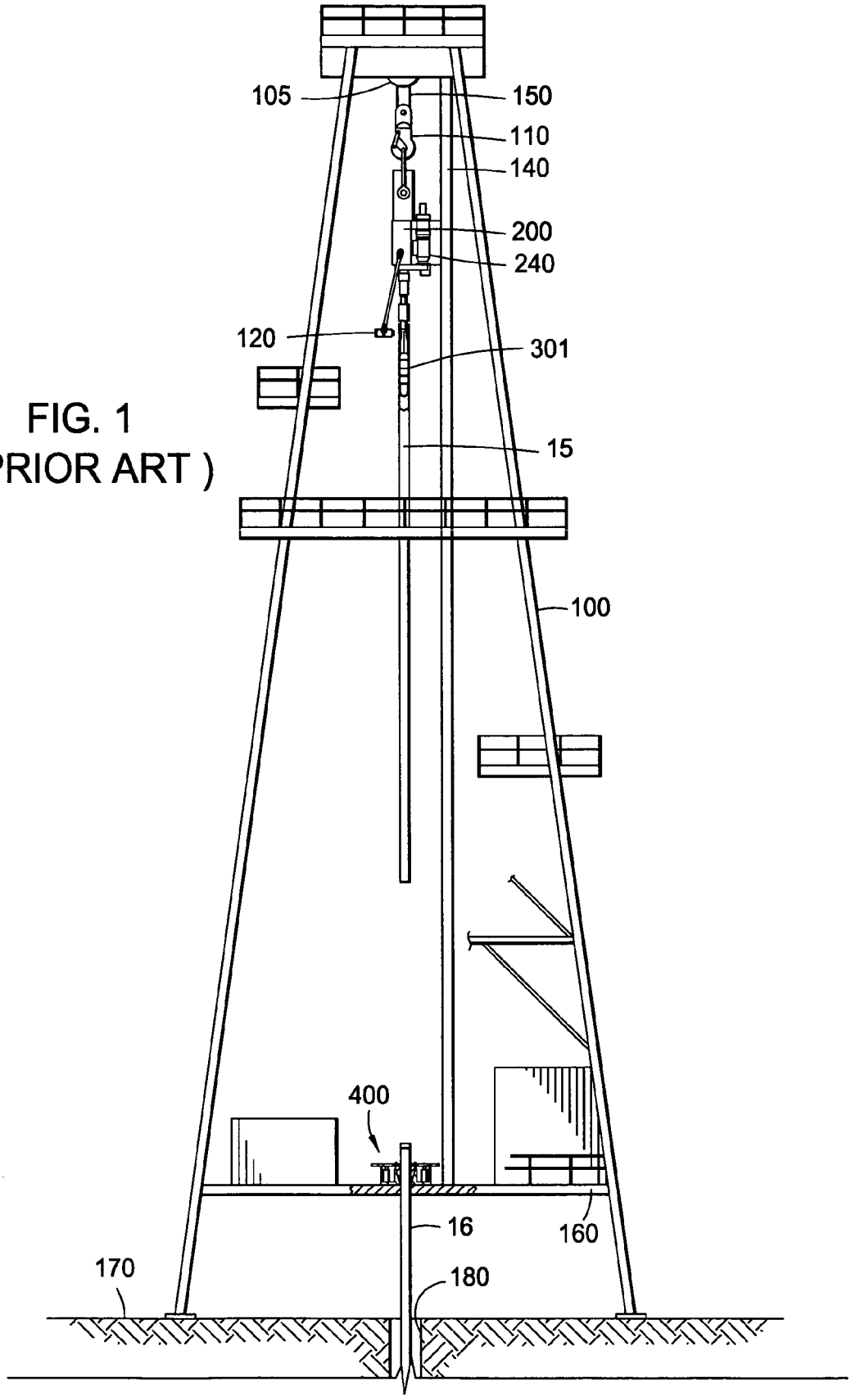
FIG. 1 ( PRIOR ART )
FIG. 1 shows a rig having a top drive and an elevator configured to connect tubulars.
Figure 2:
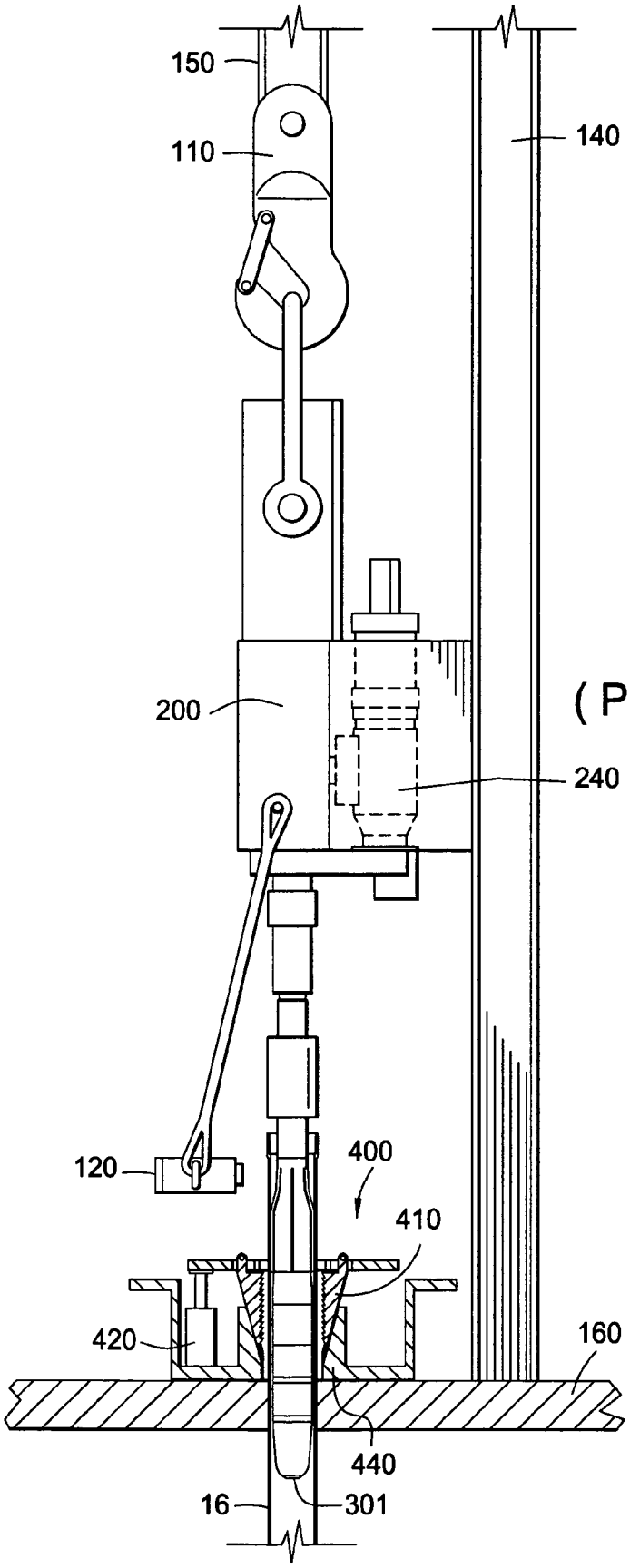
FIG. 2 ( PRIOR ART )
FIG. 2 illustrates the top drive engaged to a tubular that has been lowered through a spider.
Figure 3:
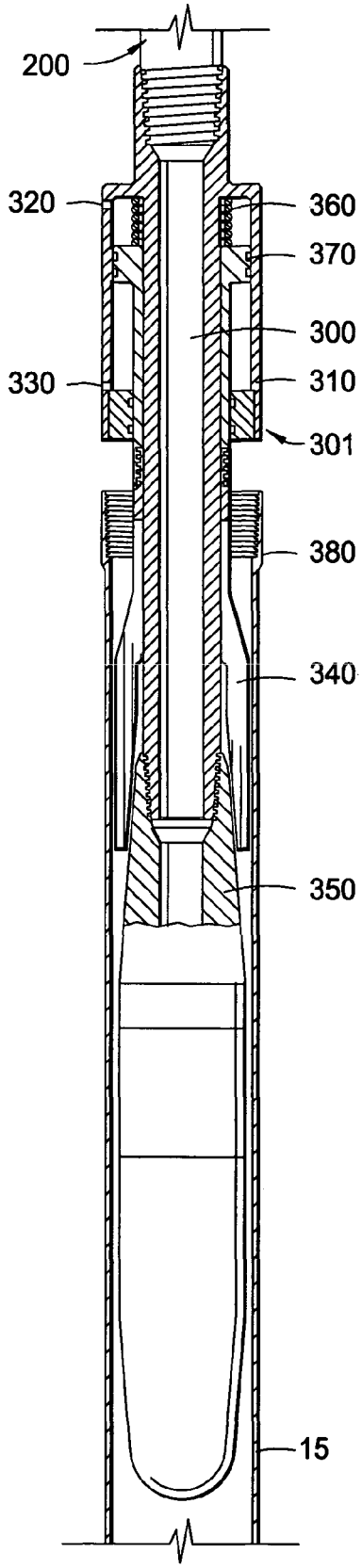
FIG. 3 is a cross-sectional view of a gripping member for use with a top drive for handling tubulars in the un-engaged position.
Figure 4:
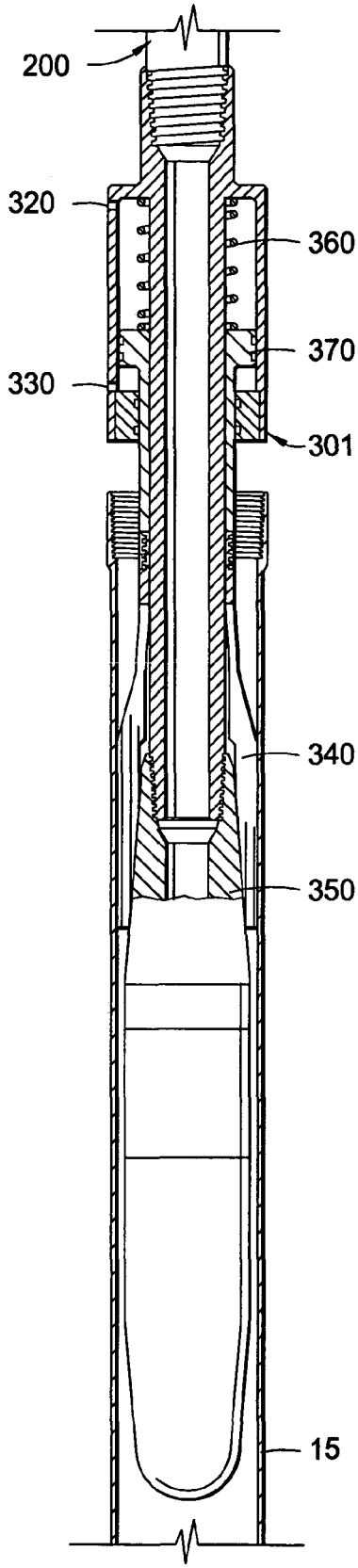
FIG. 4 is a cross-sectional view of the gripping member of FIG. 3 in the engaged position.
Figure 5:
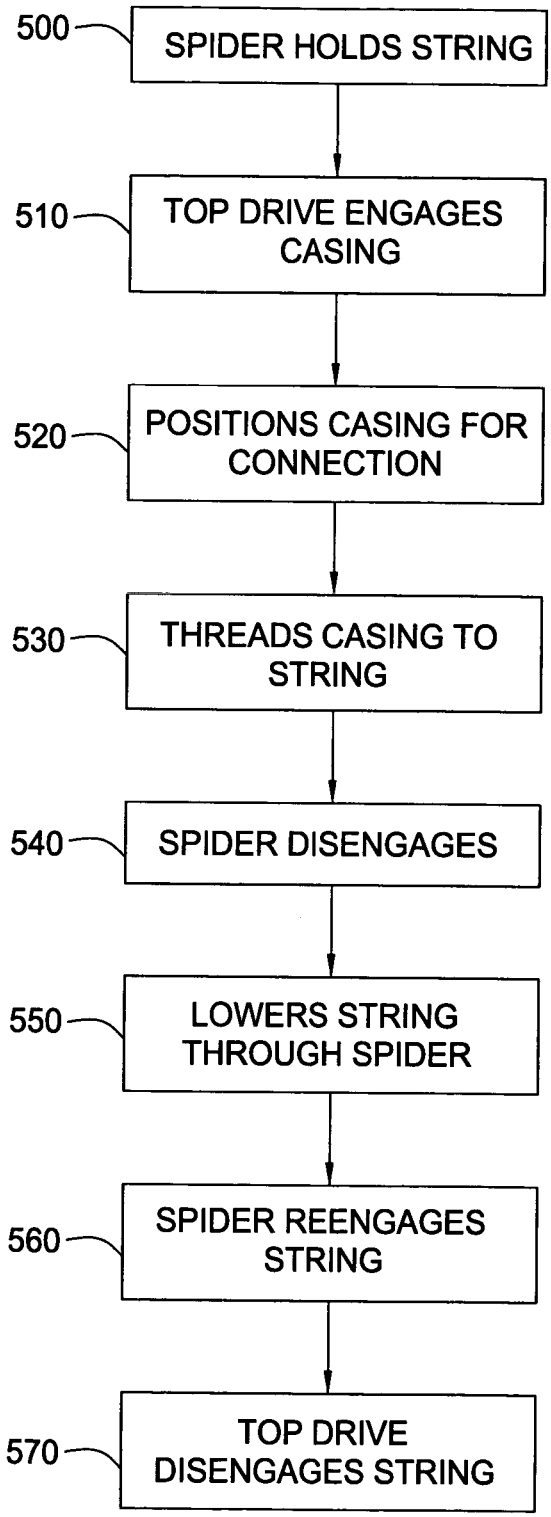
FIG. 5 is a flow chart for connecting tubulars using a top drive and a spider.
Figure 6:
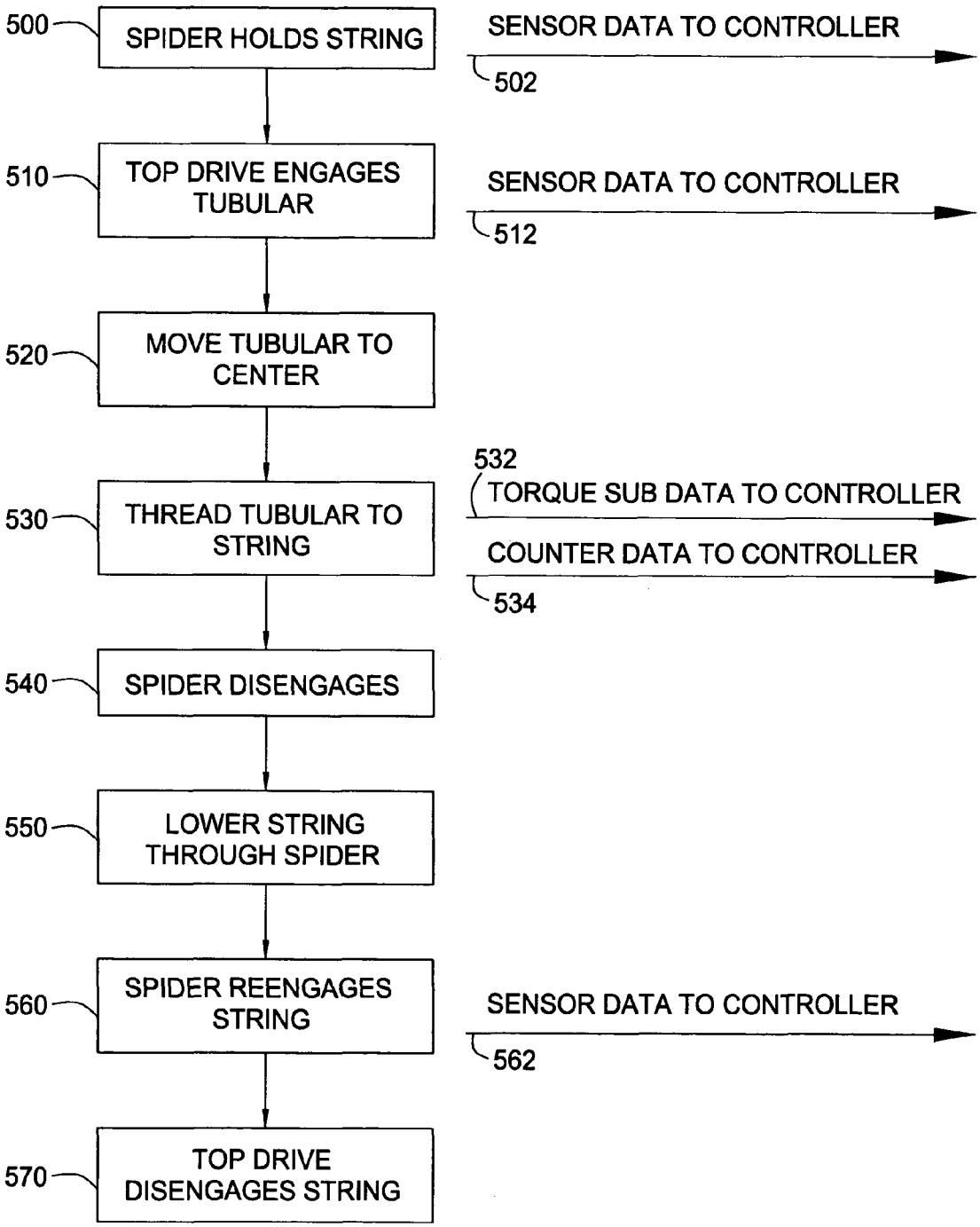
FIG. 6 shows a flow chart for connecting tubulars using an interlock system for a spider and a top drive according to aspects of the present invention.
Figure 8:
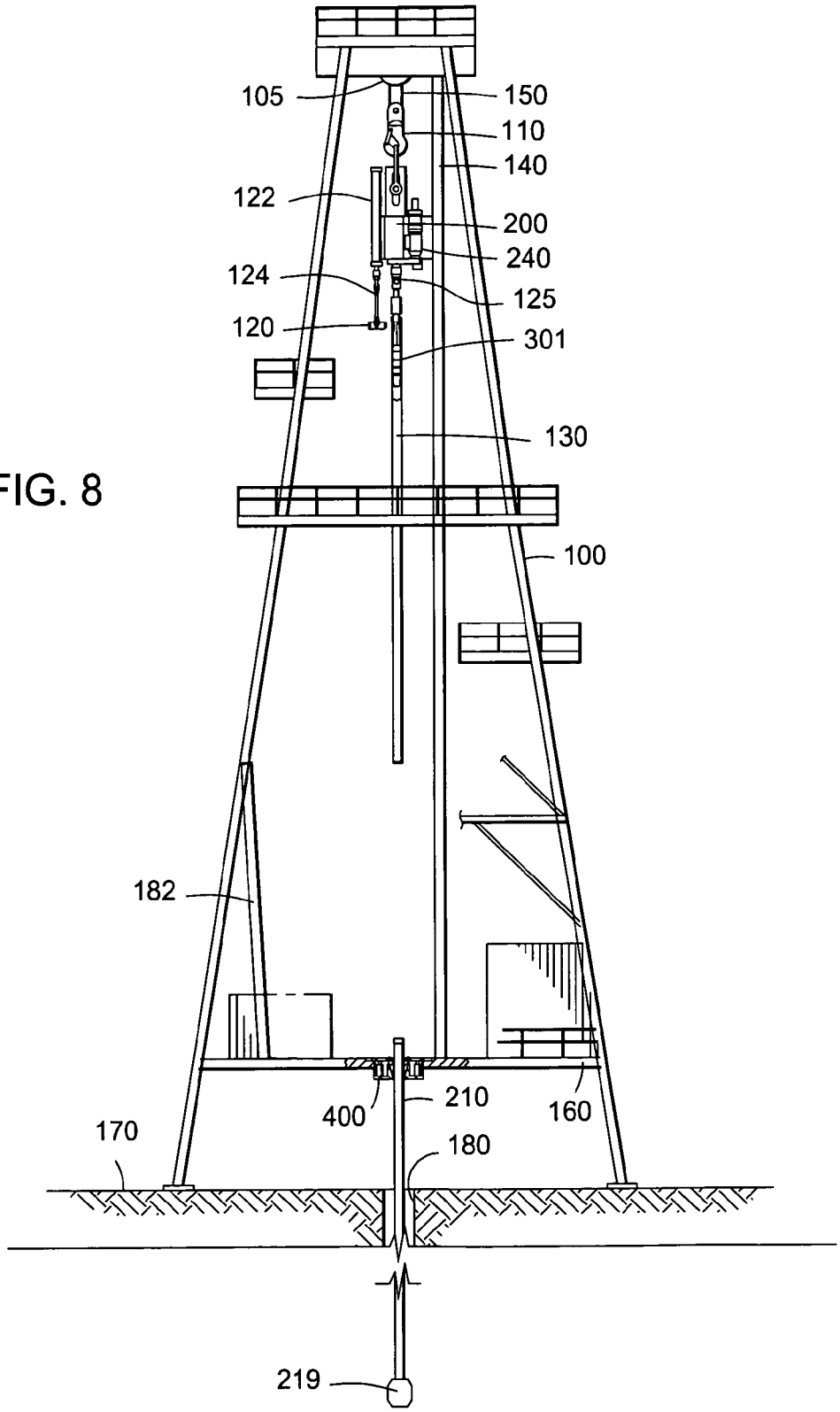
FIG. 8 illustrates the top drive of FIG. 7 after it has engaged the tubular.
Figure 10:
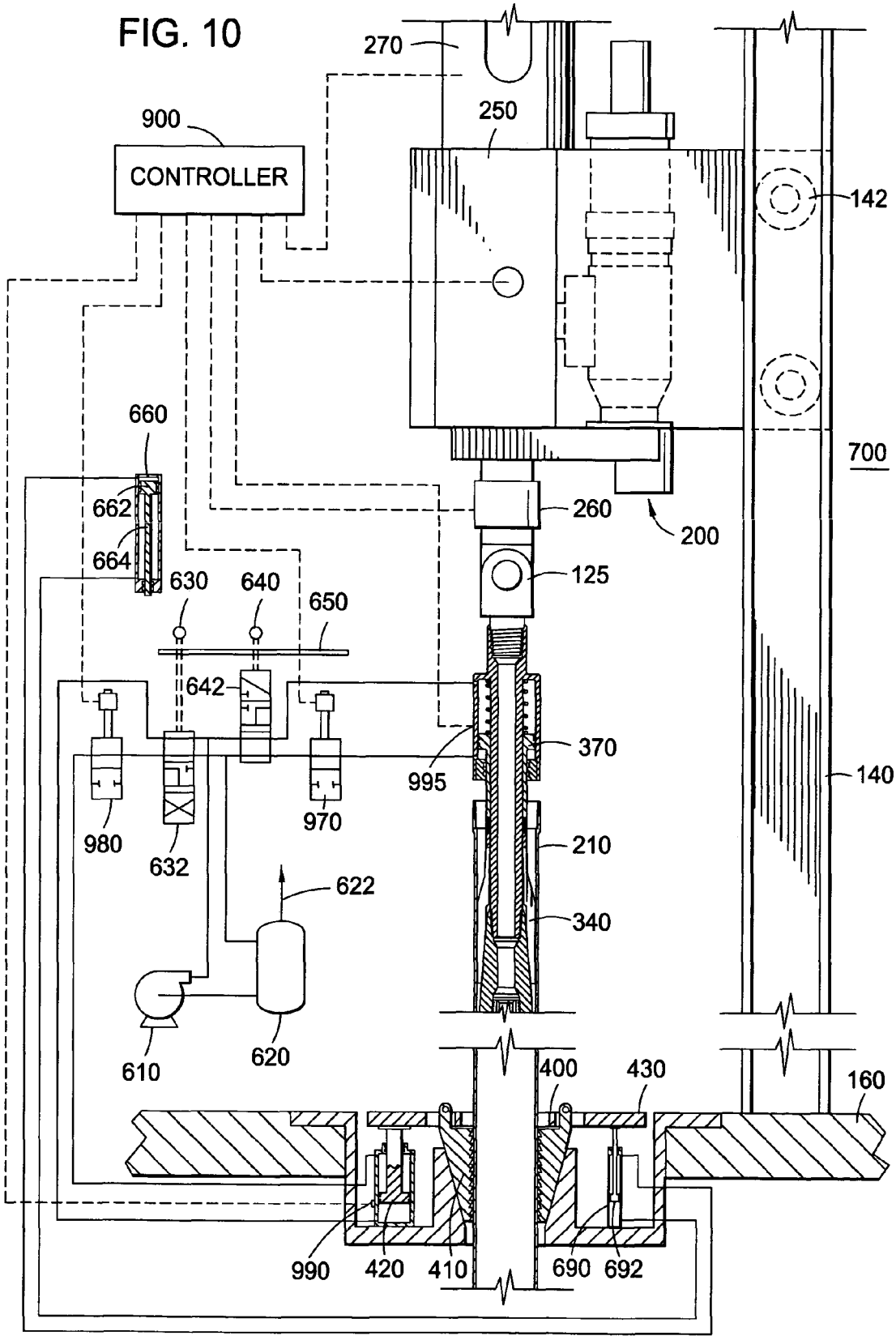
FIG. 10 illustrates the mechanics of the interlock system in use with a spider, a top drive and a controller according to aspects of the present invention.

FIG. 6 is a flow chart illustrating the use of an interlock system 700 of the present invention with a spider 400 and a top drive 200, and FIG. 10 illustrates the mechanics of the interlock system 700 in use with a spider 400, a top drive 200, and a controller 900. At step 500, a casing string 210 is retained in a closed spider 400 and prevented from moving in an axial direction, as illustrated in FIG. 8. The casing string 210 includes a cutting member 219 disposed at a lower end. In one embodiment, the spider 400 is a flush mounted spider that is disposed in the platform 160. Referring to FIG. 10, the spider 400 includes a spider piston sensor 990 located at a spider piston 420 to sense when the spider 400 is open or closed around the casing string 210. The sensor data 502 is relayed to a controller 900.

A controller 900 includes a programmable central processing unit that is operable with a memory, a mass storage device, an input control unit, and a display unit. Additionally, the controller 900 includes well-known support circuits such as power supplies, clocks, cache, input/output circuits and the like. The controller 900 is capable of receiving data from sensors and other devices and capable of controlling devices connected to it.

One of the functions of the controller 900 is to prevent opening of the spider 400. Preferably, the spider 400 is locked in the closed position by a solenoid valve 980 that is placed in the control line between the manually operated spider control lever 630 and the source of fluid power operating the spider 400. Specifically, the spider solenoid valve 980 controls the flow of fluid to the spider piston 420. The solenoid valve 980 is operated by the controller 900, and the controller 900 is programmed to keep the valve 980 closed until certain conditions are met. While valve 980 is electrically powered in the embodiment described herein, the valve 980 could be fluidly or pneumatically powered so long as it is controllable by the controller 900. Typically, the valve 980 is closed and the spider 400 is locked until a tubular 130 is successfully joined to the string 210 and held by the top drive 200.

At step 510, the top drive 200 is moved to engage a casing 130. In one embodiment, the casing 130 may be stored on a rack 182 next to the wellbore 180. Referring back to FIG. 7, the elevator 120 is coupled to the top drive 200 using a piston and cylinder assembly 122 and a pair of bails 124. The piston and cylinder assembly 122 may serve to axially translate the elevator 120 relative to the gripping means 301 of the top drive 200. As shown, the gripping means 301, also known as a gripping head, is an internal gripping apparatus, wherein it may be inserted into the casing 130 to engage an interior surface thereof. In one embodiment, a pivotable mechanism 125 is employed to facilitate the engagement of the gripping means 301 to the casing 130. An example of a suitable pivotable mechanism 125 includes a swivel 125 having a first portion 125A pivotable relative to a second portion 125B. The swivel 125 couples the gripping means 301 to the top drive 200 and allows the gripping means 301 to move or pivot relative thereto. Particularly, first and second portions 125A, 125B include connections means for connecting to the top drive 200 and the gripping means 301, respectively. Preferably, the pivotable mechanism 125 includes a bore therethrough for fluid communication between the top drive 200 and the gripping means 301.

Figure 7:
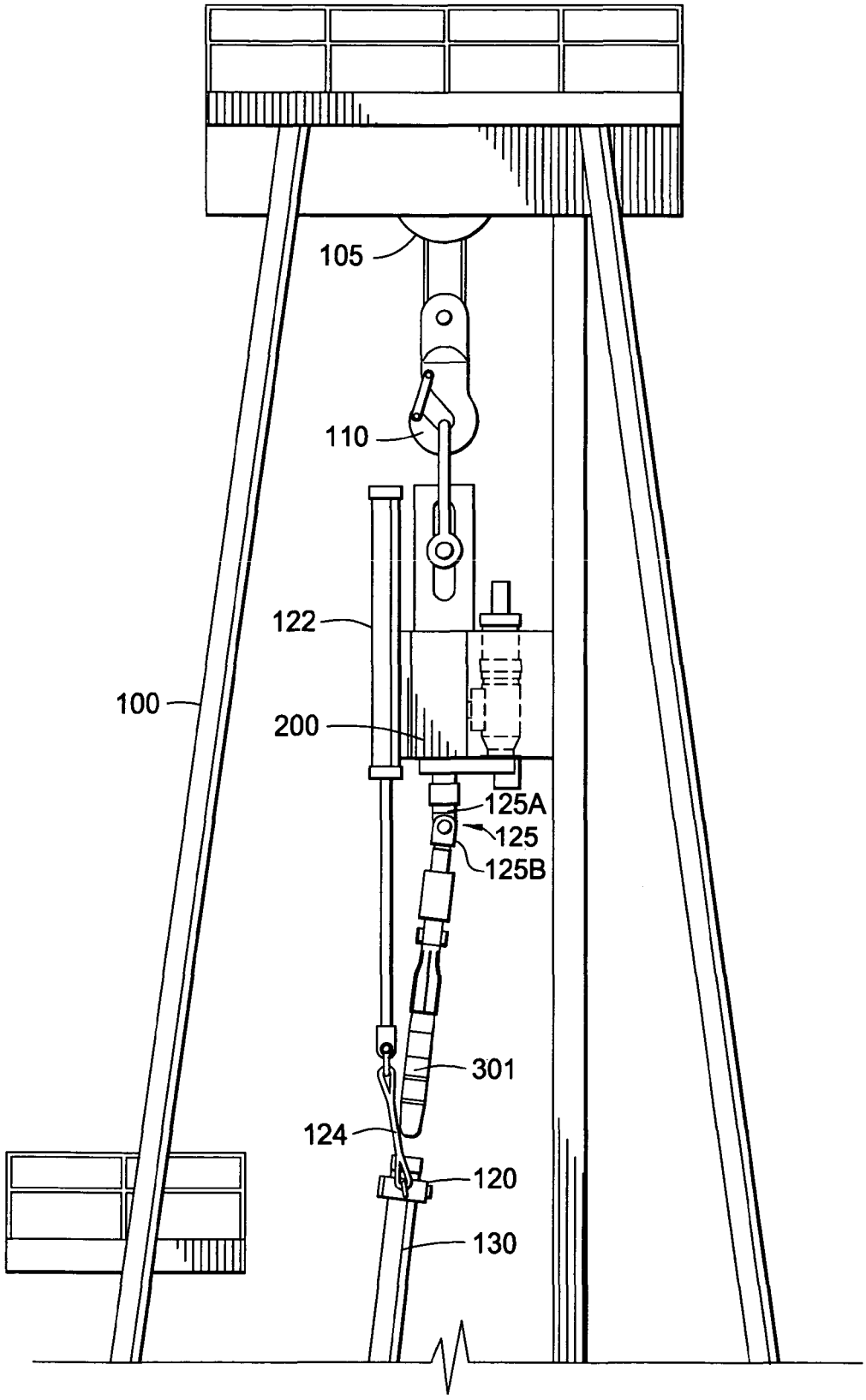
FIG. 7 illustrates an apparatus for connecting tubulars according to aspects of the present invention. The top drive is shown before it has engaged the tubular.

To engage the casing 130, the piston and cylinder assembly 122 is actuated to position the elevator 120 proximate the casing 130. The elevator 120 is then disposed around the casing 130. The movable bails 124 allow the casing 130 to tilt toward the well center. Thereafter, the gripping means 301 may be pivoted into alignment with the casing 130 for insertion thereof. Particularly, the swivel 125 is actuated to pivot the gripping means 301 as illustrated in FIG. 7. Once aligned, the gripping means 301 is inserted into the casing 130, and the slips 340 are actuated to engage the interior of the casing 130.

In one aspect, a top drive sensor 995 (FIG. 10) is placed near a top drive piston 370 to determine whether the gripping means 301 is engaged with the casing 130. The sensor data 512 is relayed to the controller 900 for processing.

At step 520, the top drive 200 moves the casing 130 into position above the casing string 210. Particularly, the swivel 125 is actuated to pivot the gripping means 301 toward the well center. In turn, the casing 130 is also positioned proximate the well center, and preferably, into alignment with the casing string 210 in the spider 400. Additionally, the traveling block 110 is actuated to lift the top drive 200 and the attached casing 130. In this manner, the casing 130 is aligned with the casing string 210 in the spider 400, as illustrated in FIG. 8.

At step 530, the top drive 200 rotationally engages the casing 130 to the casing string 210, thereby creating a threaded joint therebetween. In one embodiment, the top drive 200 may include a counter 250. The counter 250 is constructed and arranged to measure the rotation of the casing 130 during the make up process. The top drive 200 may also be equipped with a torque sub 260 to measure the amount of torque placed on the threaded connection. Torque data 532 from the torque sub 260 and rotation data 534 from the counter 250 are sent to the controller 900 for processing. The controller 900 is preprogrammed with acceptable values for rotation and torque for a particular connection. The controller 900 compares the rotation data 534 and the torque data 532 from the actual connections and determines if they are within the accepted values. If not, then the spider 400 remains locked and closed, and the casing 130 can be re-threaded or some other remedial action can take place by sending a signal to an operator. If the values are acceptable, the controller 900 locks the top drive 200 in the engaged position via a top drive solenoid valve 970 (FIG. 10) that prevents manual control of the top drive 200.

Figure 9:
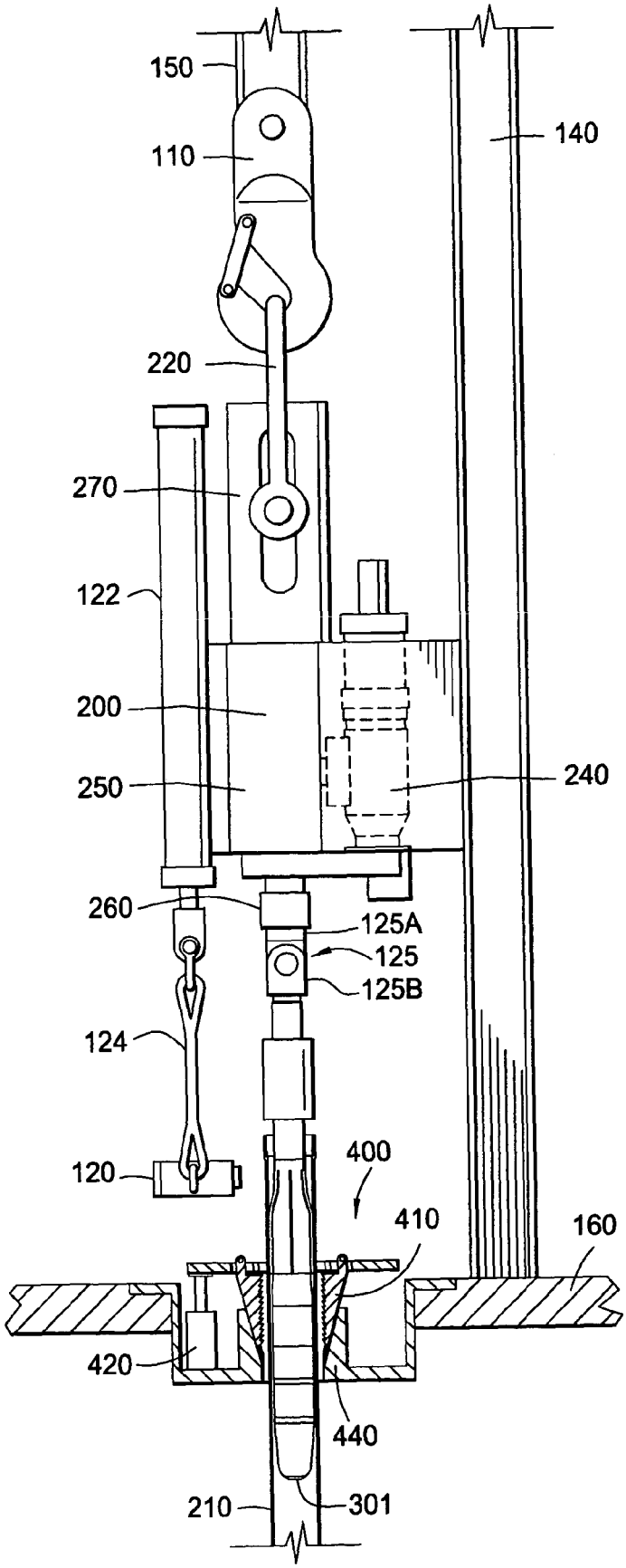
FIG. 9 illustrates the top drive of FIG. 7 after it has lowered the tubular toward the rig floor.

At step 540, the controller 900 unlocks the spider 400 via the spider solenoid valve 980, and allows fluid to power the piston 420 to open the spider 400 and disengage it from the casing string 210. At step 550, the top drive 200 lowers the casing string 210, including casing 130, through the opened spider 400. FIG. 9 shows the casing 130 lowered by the top drive 200.

At step 560, the spider 400 is closed around the casing string 210. At step 562, the spider sensor 990 (FIG. 10) signals to the controller 900 that the spider 400 is closed. If a signal is received confirming that the spider 400 is closed, the controller 900 locks the spider 400 in the closed position, and unlocks the top drive 200. If no signal is received, the top drive 200 stays locked and engaged to casing string 210. At step 570, after a signal is received, the top drive 200 disengages the casing string 210 and may proceed to add another casing 130. In this manner, at least the top drive 200 or the spider 400 is engaging the casing string 210 at all times.

Alternatively, or in addition to the foregoing, a compensator 270 may be utilized to gather additional information about the joint formed between the tubular and the tubular string. In one aspect, the compensator 270 couples the top drive 200 to the traveling block 110. The compensator 270 may function similar to a spring to compensate for vertical movement of the top drive 200 during threading of the casing 130 to the casing string 210. The compensator 270, in addition to allowing incremental movement of the top drive 200 during threading together of the tubulars, may be used to ensure that a threaded joint has been made and that the tubulars are mechanically connected together. For example, after a joint has been made between the tubular and the tubular string, the top drive may be raised or pulled up. If a joint has been formed between the tubular and the string, the compensator will "stoke out" completely, due the weight of the tubular string therebelow. If however, a joint has not been formed between the tubular and the string due to some malfunction of the top drive or misalignment between a tubular and a tubular string therebelow, the compensator will stroke out only a partial amount due to the relatively little weight applied thereto by the single tubular or tubular stack. A stretch sensor located adjacent the compensator, can sense the stretching of the compensator 270 and can relay the data to a controller 900. Once the controller 900 processes the data and confirms that the top drive is engaged to a complete tubular string, the top drive 200 is locked in the engaged position, and the next step 540 can proceed. If no signal is received, then the spider 400 remains locked and a signal maybe transmitted by the controller to an operator. During this "stretching" step, the spider 400 is not required to be unlocked and opened. The spider 400 and the slips 410 are constructed and arranged to prevent downward movement of the string but allow the casing string 210 to be lifted up and moved axially in a vertical direction even though the spider is closed. When closed, the spider 400 will not allow the casing string 210 to fall through its slips 410 due to friction and the shaped of the teeth on the spider slips.

The interlock system 700 is illustrated in FIG. 10 with the snider 400, the top drive 200, and the controller 900 including various control, signal, hydraulic, and sensor lines. The top drive 200 is shown engaged to a casing string 210 and is coupled to a railing system 140. The railing system 140 includes wheels 142 allowing the top drive 200 to move axially. The spider 400 is shown disposed in the platform 160 and in the closed position around the casing string 210. The spider 400 and the top drive 200 may be pneumatically actuated, however the spider 400 and top drive 200 discussed herein are hydraulically activated. Hydraulic fluid is supplied to a spider piston 420 via a spider control valve 632. The spider control valve 632 is a three-way valve and is operated by a spider lever 630.

Also shown in FIG. 10 is a sensor assembly 690 with a piston 692 coupled to spider slips 410 to detect when the spider 400 is open or closed. The sensor assembly 690 is in communication with a locking assembly 660, which along with a control plate 650 prevents the movement of the spider 400 and top drive lever. The locking assembly 660 includes a piston 662 having a rod 664 at a first end. The rod 564 when extended, blocks the movement of the control plate 550 when the plate is in a first position. When the spider 400 is in the open position, the sensor assembly 690 communicates to the locking assembly 660 to move the rod 664 to block the control plate's 650 movement. When the spider 400 is in the closed position as shown, the rod 664 is retracted allowing the control plate 650 to move freely from the first to a second position. Additionally, the sensor assembly 660 can also be used with the top drive 200 as well in the same fashion. Similarly, hydraulic fluid is supplied to a top drive piston 370 via a top drive control valve 642 and hydraulic lines. The top drive control valve 642 is also a three-way valve and is operated by a top drive lever 640. A pump 610 is used to circulate fluid to the respective pistons 370, 420. A reservoir 620 is used to re-circulate hydraulic fluid and receive excess fluid. Excess gas in the reservoir 620 is vented 622.

Further shown in FIG. 10, controller 900 collects data from a top drive sensor 995 regarding the engagement of the top drive to the casing string 210. Data regarding the position of the spider 400 is also provided to the controller 900 from a spider sensor 990. The controller 900 controls fluid power to the top drive 200 and spider 400 via solenoid valves 970, 980, respectively.

In FIG. 10, the top drive 200 is engaged to casing string 210 while the spider 400 is in the closed position around the same casing string 210. At this point, steps 500, 510, 520, and 530 of FIG. 6 have occurred. Additionally, the controller 900 has determined through the data received from counter 250 and torque sub 260 that an acceptable threaded joint has been made between casing 130 and casing string 210. In the alternative or in addition to the foregoing, a compensator 270 can also provide data to the controller 900 that a threaded joint has been made and that the casing 130 and the casing string 210 are mechanically connected together via a stretch sensor (not shown). The controller 900 then sends a signal to a solenoid valve 970 to lock and keep a top drive piston 370 in the engaged position within the casing string 210. Moving to step 540 (FIG. 6), the controller 900 can unlock the previously locked spider 400, by sending a signal to a solenoid valve 980. The spider 400 must be unlocked and opened in order for the top drive 200 to lower the casing string 210 through the spider 400 and into a wellbore. An operator (not shown) can actuate a spider lever 630 that controls a spider valve 632, to allow the spider 400 to open and disengage the casing string 210. When the spider lever 630 is actuated, the spider valve 632 allows fluid to be flow to spider piston 420 causing spider slips 410 to open. With the spider 400 opened, a sensor assembly 690 in communication with a locking assembly 660 will cause a rod 664 to block the movement of a control plate 650. Because the plate 650 will be blocked in the rightmost position, the top drive lever 640 is held in the locked position and will be unable to move to the open position.

Figure 11:
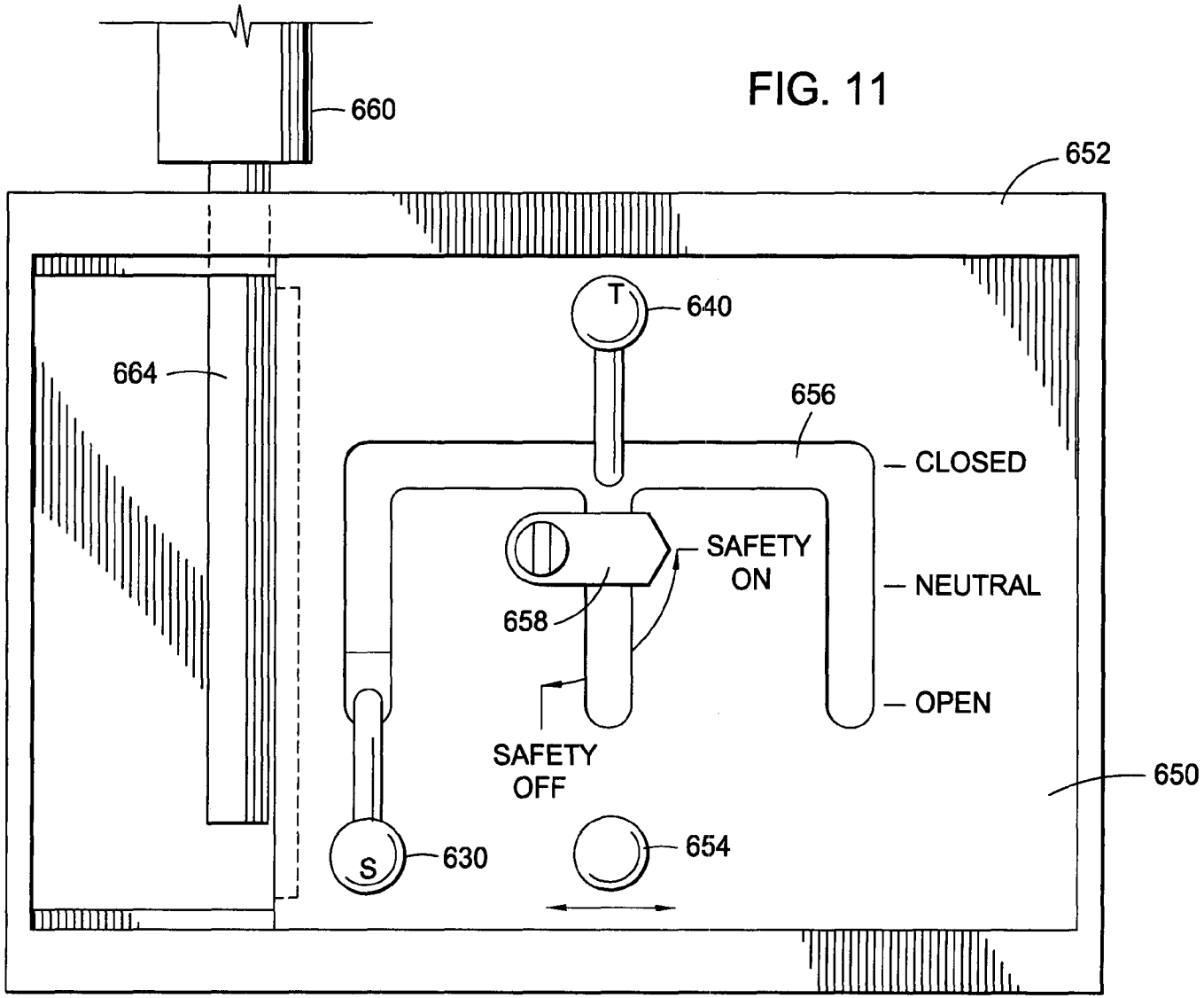
FIG. 11 illustrates a control plate for a spider lever and a top drive lever according to aspects of the present invention.

As illustrated in FIG. 10, the interlock system 700 when used with the top drive 200 and the spider 400 prevents the operator from inadvertently dropping the casing string 210 into the wellbore. As disclosed herein, the casing string 210 at all times is either engaged by the top drive 200 or the spider 400. Additionally, the controller 900 may prevent operation of the top drive 200 under certain situations, even if the top drive control lever 640 is actuated In another aspect, the interlock system 700 may include a control plate 650 to control the physical movement of levers 630, 640 between the open and closed positions, thereby preventing the operator from inadvertently actuating the wrong lever. FIG. 11 illustrates a control plate 650 for a spider lever 630 and a top drive lever 640 that can be used with the interlock system 700 of the present invention. The control plate 650 is generally rectangular in shape and is provided with a series of slots 656 to control the movement of the spider lever 630, and the top drive lever 640. Typically, the control plate 650 is slideably mounted within a box 652. The slots 656 define the various positions in which the levers 630, 640 may be moved at various stages of the tubular assembly or disassembly. The levers 630, 640 can be moved in three positions: (1) a neutral position located in the center; (2) a closed position located at the top and causes the slips to close; and (3) an open position located at the bottom, which causes the slips to open. The control plate 650 can be moved from a first rightmost position to a second leftmost position with a knob 654. However, both levers 630, 640 must be in the closed position before the control plate is moved from one position to another. The control plate 650 is shown in the first rightmost position with a rod 664 extending from a locking assembly 660 to block the movement of the control plate. In operation, in the first rightmost position of the control plate 650, the spider lever 630 can be moved between the open and close positions, while the top drive lever 640 is kept in the closed position. In the second leftmost position, the top drive lever 640 can be moved between the open and close positions, while the spider lever 630 is kept in the closed position. A safety lock 658 is provided to allow the top drive or spider levers 630, 640 to open and override the control plate 650 when needed.

The interlock system 700 may be any interlock system that allows a set of slips to disengage only when another set of slips is engaged to the tubular. The interlock system 700 may be mechanically, electrically, hydraulically, pneumatically actuated systems. The spider 400 may be any spider that functions to hold a tubular or a tubular string at the surface of the wellbore. A top drive 200 may be any system that includes a gripping means for retaining a tubular by the inner or outer surface and can rotate the retained tubular. The gripping means may include an internal gripping apparatus such as a spear, an external gripping apparatus such as a torque head, or any other gripping apparatus for gripping a tubular as known to a person of ordinary skill in the art. For example, the external gripping apparatus may include a sensor for detecting information from its slips to ensure proper engagement of the casing. The top drive 200 can also be hydraulically or pneumatically activated.

While the foregoing is directed to the preferred embodiment of the present invention, other and further embodiments of the invention may be devised without departing from the basic scope thereof, and the scope thereof is determined by the claims that follow.

I claim:

1. An apparatus for picking up a casing string from a rack and moving the casing string toward a center of a well for use with a top drive, comprising:

a tubular gripping member attached to a structural intermediate, wherein the structural intermediate is pivotable from the top drive to move the casing string toward the center of the well and wherein the tubular gripping member is rotatable by the top drive and wherein the structural intermediate and the gripping member are in fluid communication with an inner diameter of the casing string.

2. The apparatus of claim 1, wherein the structural intermediate comprises a first portion pivotable with respect to a second portion.

3. The apparatus of claim 2, wherein the first portion is operatively connected to the top drive and the second portion is operatively connected to the tubular gripping member.

4. A method for use in drilling with casing with a top drive, comprising:

providing a tubular gripping member pivotally connected to the top drive, wherein the tubular gripping member is rotatable relative to the top drive;

locating the top drive at a center of a well;

pivoting the tubular gripping member away from the center of the well;

engaging a casing with the tubular gripping member;

pivoting the tubular gripping member toward the center of the well; and supplying fluid from the tubular gripping member to the casing.

5. The method of claim 4, further comprising connecting the casing to a casing string with a cutting structure disposed at its lower end.

6. The method of claim 5, further comprising rotating the casing string.

7. The method of claim 5, further comprising allowing incremental movement of the top drive while the casing is connected to the casing string.

8. The method of claim 7, further comprising providing a compensator to allow for the incremental movement of the top drive.

9. The method of claim 5, further comprising providing a stretch sensor to determine a connection between the casing and the casing string.

10. The method of claim 4, wherein the tubular gripping member comprises a torque head.

11. The method of claim 4, wherein the tubular gripping member comprises a spear.

12. The method of claim 4, wherein a structural intermediate pivotally connects the tubular gripping member to the top drive.

13. The method of claim 12, wherein the structural intermediate is rotationally fixed relative to the tubular gripping member and is rotatable relative to the top drive.

14. A method for moving a casing string to a center of a well, comprising:

providing a top drive and a tubular gripping member pivotally connected by a tubular structural intermediate;

pivoting the structural intermediate to bias the tubular gripping member toward the casing string;

grippingly engaging the casing string with the tubular gripping member so that the casing string and the tubular gripping member are rotationally and axially fixed relative to one another; and moving the casing string to the center of the well.

15. The method of claim 14, wherein moving the casing string to the center of the well comprises pivoting the structural intermediate to move the casing string to the center of the well.

16. A top drive adapter for gripping a casing string in a non-vertical position with respect to the center of a well, comprising:

a tubular gripping member for gripping the casing string in the non-vertical position; and a tubular structural intermediate for biasing the tubular gripping member away from the center of the well, wherein the top drive adapter is rotatable relative to the top drive.

17. A system for handling a tubular, comprising:

a top drive;

a first gripping member operatively coupled to the top drive;

a second gripping member; and an interlock system connected to the first gripping member and the second gripping member, the interlock system adapted to ensure that at least one of the first gripping member or the second gripping member is connected to the tubular.

18. The system of claim 17, further comprising a compensator.

19. The system of claim 17, further comprising a stretch sensor.

20. The system of claim 17, further comprising a counter to measure rotation of the tubular.

21. The system of claim 17, further comprising a torque sub to measure torque exerted on the tubular.

22. The system of claim 17, wherein the tubular comprises a casing.

23. The system of claim 17, wherein the tubular comprises a casing connected to a casing string.

24. The system of claim 23, wherein the tubular comprises a cutting member disposed at a lower portion of the tubular.

25. The system of claim 17, further comprising a pivotable mechanism for pivoting the first gripping member.

26. A method for use in drilling with casing with a top drive, comprising:

providing a tubular gripping member pivotally connected to the top drive, wherein the tubular gripping member is rotatable relative to the top drive;

providing a stretch sensor to determine a connection between the casing and the casing string;

locating the top drive at a center of a well;

pivoting the tubular gripping member away from the center of the well;

engaging a casing with the tubular gripping member;

pivoting the tubular gripping member toward the center of the well; and connecting the casing to a casing string with a cutting structure disposed at its lower end.

27. A method for use in drilling with casing with a top drive, comprising:

providing a tubular gripping member pivotally connected to the top drive, wherein the tubular gripping member is rotatable relative to the top drive, wherein the tubular gripping member comprises a spear;

locating the top drive at a center of a well;

pivoting the tubular gripping member away from the center of the well;

engaging a casing with the tubular gripping member; and pivoting the tubular gripping member toward the center of the well.

28. The method of claim 27, further comprising supplying a fluid from the spear to the casing.

29. The method of claim 27, further comprising rotating the casing to extend the well.

30. An apparatus for use with a top drive, comprising:

a pivotable mechanism connected to a lower end of the top drive, wherein the pivotable mechanism has a bore therethrough and is pivotable towards and away from the top drive;

a gripping head connected to a lower end of the pivotable mechanism and pivotable by the pivotable mechanism, wherein the gripping head grippingly engages a casing string;

a compensator; and a stretch sensor.

31. The apparatus of claim 30, wherein the stretch sensor determines a stretching of the compensator.

32. A system for handling a tubular, comprising:

a top drive;

a first gripping member operatively coupled to the top drive;

a second gripping member;

an interlock system for ensuring that at least one of the first gripping member or the second gripping member is connected to the tubular; and a stretch sensor.

33. A system for handling a tubular, comprising:

a top drive;

a first gripping member operatively coupled to the top drive;

a second gripping member;

an interlock system for ensuring that at least one of the first gripping member or the second gripping member is connected to the tubular; and a counter to measure rotation of the tubular.

34. An apparatus for picking up a casing string from a rack and moving the casing string toward a center of a well for use with a top drive, comprising:

a tubular gripping member attached to a structural intermediate, wherein the structural intermediate is pivotable from the top drive to move the casing string toward the center of the well and wherein the structural intermediate and the gripping member provide fluid communication to an inner diameter of the casing string.

35. An apparatus for use with a top drive, comprising:

a pivotable mechanism connected to a lower end of the top drive, wherein the pivotable mechanism has a bore adapted for fluid flow therethrough and is pivotable towards and away from the top drive; and a gripping head connected to a lower end of the pivotable mechanism and pivotable by the pivotable mechanism, wherein the gripping head grippingly engages a casing string.

36. An apparatus for use with a top drive, comprising:

a pivotable mechanism connected to a lower end of the top drive, wherein the pivotable mechanism has a bore therethrough and is pivotable towards and away from the top drive;

a gripping head connected to a lower end of the pivotable mechanism and pivotable by the pivotable mechanism, wherein the gripping head grippingly engages a casing string; and a compensator.

37. The apparatus of claim 36, further comprising a stretch sensor.

38. The apparatus of claim 37, wherein the stretch sensor determines a stretching of the compensator.

* * * * *